US006231272B1

(12) United States Patent
Bishop

(10) Patent No.: US 6,231,272 B1
(45) Date of Patent: May 15, 2001

(54) CONSTRUCTION BLOCK FOR MAKING VARIOUS STRUCTURES

(76) Inventor: Merrill E. Bishop, 1363 Wimbledon Way, Charlottesville, VA (US) 22901

( * ) Notice: Subject to any disclaimer, the term of this patent is extended or adjusted under 35 U.S.C. 154(b) by 0 days.

(21) Appl. No.: 09/460,835

(22) Filed: Dec. 14, 1999

(51) Int. Cl.[7] ..... E02D 29/02

(52) U.S. Cl. ..... 405/286; 405/284; 52/604; 52/592.1; 52/592.6

(58) Field of Search ..... 405/284, 286; 52/604, 592.1, 592.6, 102; 47/33

(56) References Cited

U.S. PATENT DOCUMENTS

| | | | | |
|---|---|---|---|---|
| 1,357,125 | * | 10/1920 | Stanton | 52/284 |
| 2,911,794 | * | 11/1959 | Pearson | 405/287 |
| 3,269,125 | | 8/1966 | Moore . | |
| 3,343,301 | * | 9/1967 | Adelman | 47/33 |
| 3,444,694 | * | 5/1969 | Frehner | 405/286 |
| 4,490,075 | | 12/1984 | Risi et al. . | |
| 4,512,685 | | 4/1985 | Hegle . | |
| 4,616,959 | * | 10/1986 | Hilfiker | 405/284 |
| 4,685,838 | | 8/1987 | Curt . | |
| 4,719,737 | | 1/1988 | Swart . | |
| 4,874,272 | | 10/1989 | Egan . | |
| 4,976,063 | | 12/1990 | Young . | |
| 4,986,042 | | 1/1991 | Richardt . | |
| 4,996,813 | * | 3/1991 | Kliethermes, Jr. et al. | 52/593 |
| 5,066,169 | | 11/1991 | Gavin et al. . | |
| 5,134,817 | * | 8/1992 | Richardt | 52/102 |
| 5,360,296 | * | 11/1994 | Angelette | 405/286 |
| 5,452,541 | * | 9/1995 | DeMaio | 47/33 |
| 5,456,555 | * | 10/1995 | Boekeler | 405/286 |
| 5,499,891 | | 3/1996 | Klenert . | |
| 5,528,873 | | 6/1996 | Correia et al. . | |
| 5,588,786 | * | 12/1996 | House et al. | 405/284 |
| 5,598,679 | * | 2/1997 | Orton et al. | 405/286 |
| 5,622,456 | | 4/1997 | Risi et al. . | |
| 5,647,185 | * | 7/1997 | Forlini | 405/284 |
| 5,791,827 | | 8/1998 | Arvai et al. . | |
| 5,921,021 | * | 7/1999 | Coates | 47/33 |
| 6,010,279 | * | 1/2000 | Taylor-Smith | 405/286 |

FOREIGN PATENT DOCUMENTS

| | | | | |
|---|---|---|---|---|
| 3126572 | * | 1/1985 | (DE) | 405/286 |

* cited by examiner

*Primary Examiner*—Eileen D. Lillis
*Assistant Examiner*—Alexander K. Pechhold
(74) *Attorney, Agent, or Firm*—Rankin, Hill, Porter & Clark LLP

(57) ABSTRACT

Construction blocks for use in constructing retaining walls, embankment stabilizing matrixes, planters, waterway protection walls, and similar structures include a generally C-shaped block, a straight block, a generally Z-shaped block, and a generally S-shaped block. The blocks have a center section having a length X. Except for the straight block, wings project outwardly from each end of the center section. The wings have a length ½X and extend from the centerline of the center section at an angle of 120 degrees. The blocks include grooves on their upper surfaces and tongues that project from their lower surfaces. The grooves and tongues are interconnected when blocks are superimposed so as to provide a stable structure. In addition, the ends of the wings include openings into which dowels can be inserted in order to connect adjacent blocks and thereby provide additional stability. The blocks are attractive, strong, and inexpensive to manufacture. They can be connected securely to each other without mortar. Moreover, the blocks are sufficiently compact and lightweight that they can be carried and installed by only one or two workers.

20 Claims, 6 Drawing Sheets

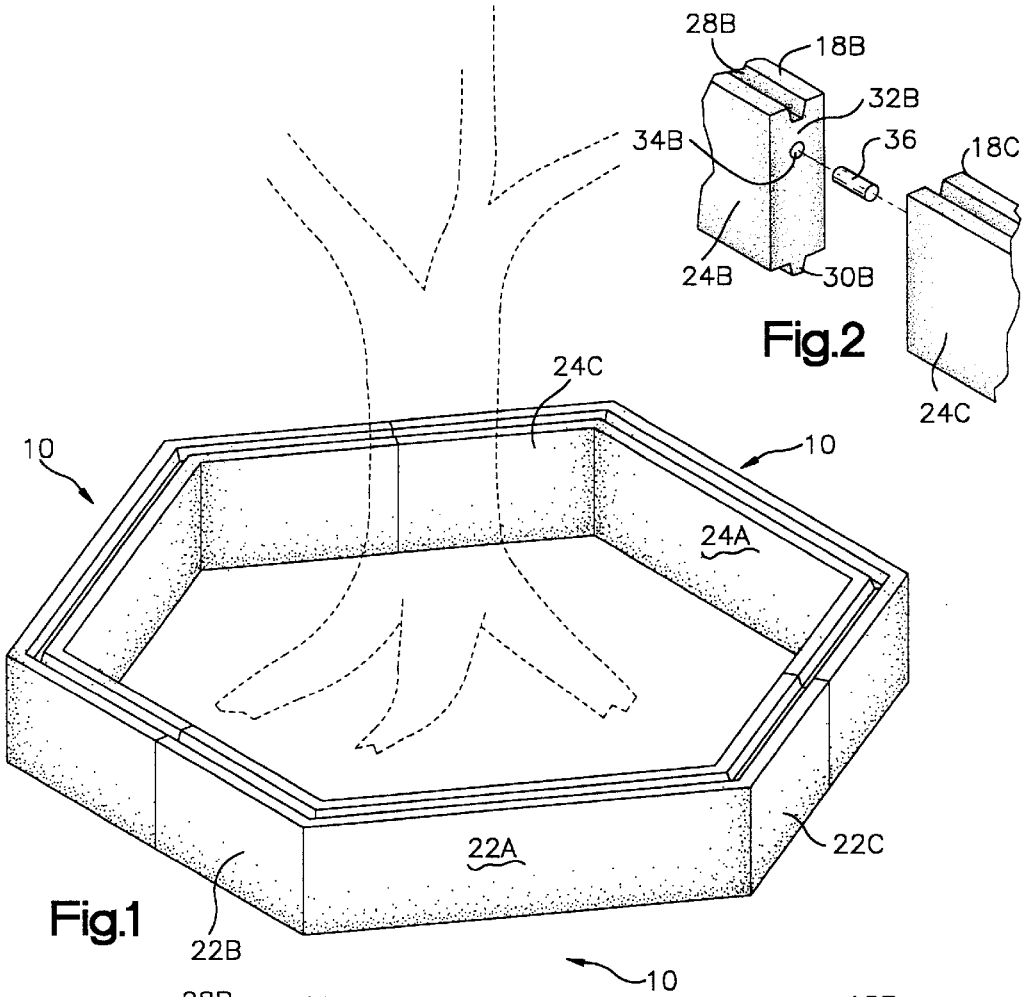
Fig.2
Fig.1
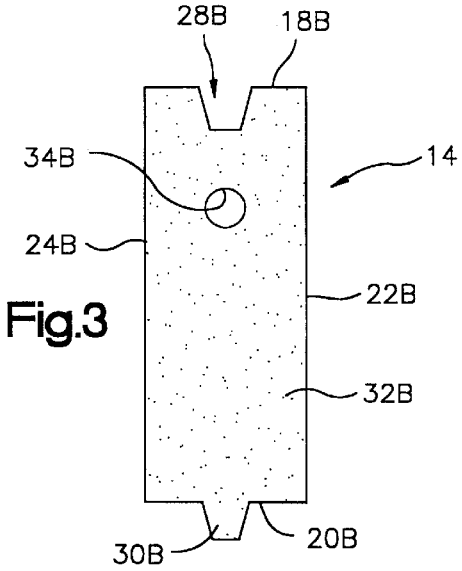
Fig.3
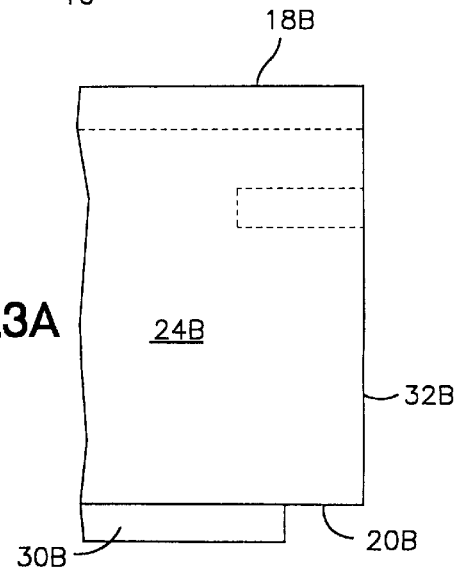
Fig.3A

CONSTRUCTION BLOCK FOR MAKING VARIOUS STRUCTURES

BACKGROUND OF THE INVENTION

1. Field of the Invention

The invention relates to construction blocks and, more particularly, to the use of such blocks to build retaining walls, embankment stabilizing matrixes, planters, ponds for aquatic plants, waterway protection walls, and similar structures.

2. Description of the Prior Art

There are numerous construction blocks and retaining wall systems in the prior art. See, for example, the patents to Risi et al., U.S. Pat. No. 4,490,075 and Moore, U.S. Pat. No. 3,269,125. A problem with prior construction blocks and structures built therefrom is that the blocks tend to be unduly complex, in many cases requiring heavy capacity lifting equipment to handle them. The blocks often are more expensive to manufacture than desired. Furthermore, prior art blocks often can be used to build only one type of structure, for example, a retaining wall.

Desirably, a construction block would be available that would be simple in design, capable of being handled by one person, and usable to construct a wide variety of structures. Preferably, any such structure could be assembled easily without the need for mortar to hold the blocks together. In addition, any such construction block and resulting structures desirably would be attractive so that their use for residential or architectural purposes would be encouraged.

SUMMARY OF THE INVENTION

In response to the forgoing concerns, the present invention provides a new and improved construction block from which various structures can be made. In order to construct a wide variety of structures, several different forms of the construction block are provided.

The most basic construction block according to the invention is a generally C-shaped member that, when assembled with two other blocks, forms a hexagonal cell with sides of 30 inches. Each block includes an elongate center section approximately 30 inches in length from which a pair of 15-inch wings extend at an included angle of 120 degrees. The upper surface of the center section and the wings is provided with a groove, while a tongue projects from the lower portion of the center section and the wings. Accordingly, the blocks can be stacked atop each other and shifting will be prevented by the interaction of the tongues and grooves. Small openings are provided in the end faces of the wings so that dowels can be inserted therein as a further aid to prevent relative movement between adjacent blocks.

Other construction blocks according to the invention include a generally Z-shaped block with an elongate center section having one wing extending from one end of the center section at an included angle of 120 degrees and with a second wing extending from the other end of the center section, on the opposite side of the center section, at an included angle of 120 degrees the other way. A third construction block according to the invention is substantially identical to the second-described block, but with the wings reversed to form generally an S-shape. A fourth variation of the construction block according to the invention employs only an elongate center section with notched end faces. The notches are cut at 30 degrees and 60 degrees from the centerline of the center section. This block will lock into the previously described C-shaped block to allow offset vertical stacking.

By using construction blocks according to the invention, a variety of sturdy, inexpensive structures can be built by only one or two workers. The blocks can be assembled easily without the need for mortar to hold the blocks together. The basic hexagonal cell can be used to make planters or small ponds for aquatic plants. Retention walls, either vertical or terraced, can be created by using different ones of the construction blocks to fit the landscape at hand. Freestanding walls of various shapes also can be built. The walls can be used as lake or river bank liners or temporary levies to control flooding. The blocks also can be used to quickly construct an inexpensive, sturdy, culvert retention wall.

The foregoing and other features and advantages of the invention will be apparent from the description and claims that follow, taken in conjunction with the accompanying drawings.

BRIEF DESCRIPTION OF THE DRAWINGS

FIG. 1 is a perspective view of generally C-shaped construction blocks according to the invention assembled to form a hexagonal tree planter;

FIG. 2 is a perspective view of a portion of two of the blocks of FIG. 1, showing the blocks in a separated position with an interconnecting dowel disposed therebetween;

FIG. 3 is an end view of one of the construction blocks of FIG. 1;

FIG. 3A is a side elevation view of a portion of a construction block according to the invention showing a tongue that terminates a short distance from the end of a wing;

DESCRIPTION OF THE PREFERRED EMBODIMENT

Figure 4:
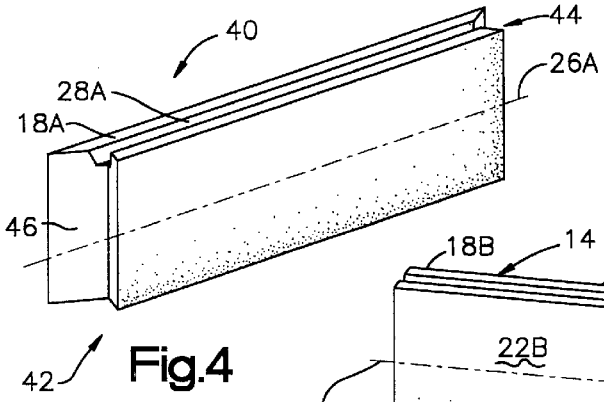
FIG. 4 is a view of an alternative construction block according to the invention in which an elongate section includes notched end faces.

Referring to FIGS. 1–3 and 5, a generally C-shaped construction block according to the invention is indicated by the reference numeral 10. The block 10 includes an elongate center section 12 from which a first wing 14 projects at one end, and a second wing 16 projects from the other end. The center section 12 and the first and second wings 14, 16 each include upper surfaces 18A, 18B, and 18C, respectively. Similarly, these elements include lower surfaces 20A, 20B, 20C, front walls 22A, 22B, 22C, back walls 24A, 24B, 24C, and longitudinal axes 26A, 26B, 26C. Grooves 28A, 28B, 28C are formed in each of the upper surfaces 18A, 18B, 18C, respectively. Similarly, tongues 30A, 30B, 30C project from the lower surfaces 20A, 20B, 20C, respectively. The wing 14 includes an end face 32B. The wing 16 includes an end face 32C. An opening 34B is formed in the end face 32B, while an opening 34C is formed in the end face 32C. A dowel 36 (FIG. 2) is provided for insertion into the openings 34B, 34C. The lower surface 20C, tongue 30C, end face 32C, and opening 34C are not illustrated in the Figures, but they correspond to lower surfaces 20A, 20B, tongues 30A, 30B, end faces 32A, 32B, and openings 34A, 34B, respectively, which are illustrated in the Figures.

In the preferred embodiment, the block 10 is formed of concrete in a molding operation. In order to facilitate manufacture and for good strength, it is preferred that the upper and lower surfaces 18, 20 and the front and back walls 22, 24 be flat, straight and perpendicular, thereby generally defining a rectangle in cross-section. The upper and lower surfaces 18, 20 should lie in a parallel planes. Similarly, for ease of manufacture and for strength, it is preferred that the groove 28 have sides that taper at approximately a 15 degree angle from the vertical to a flat bottom. Preferably, the bottom of the groove 28 is approximately 0.75 inch wide, and the opening into the groove 28 is approximately 1.25 inches wide. The tongue 30 should closely match the size and shape of the groove 28 in order to minimize shifting of superimposed blocks 10 relative to each other. Preferably, the end of the tongue 28 is approximately 0.625 inch wide and the base of the tongue 30 is approximately one inch wide. The groove 28 and the tongue 30 are approximately 0.875 inch and 0.625 inch deep, respectively. The opening 34 is approximately 0.75 inch in diameter and approximately 3.0 inches deep. The dowel 36 is slightly less than 0.75 inch in diameter, and it should have an overall length of slightly less than six inches.

Figure 5:
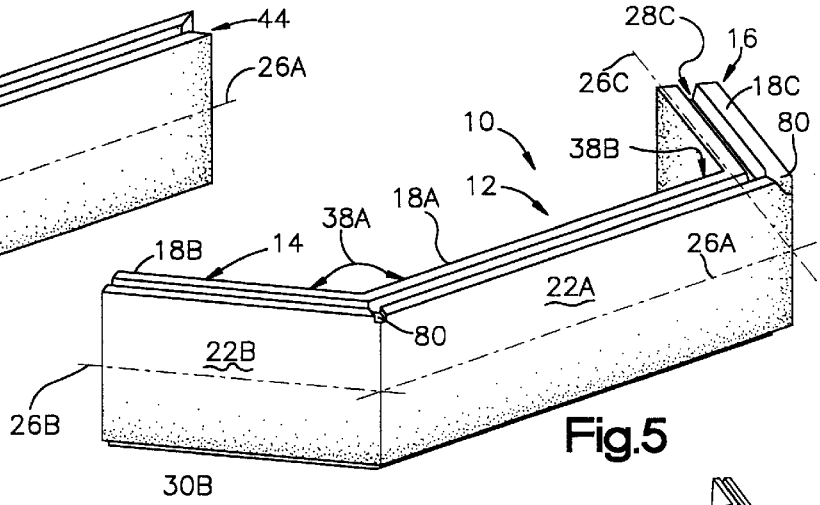
FIG. 5 is a perspective view of one the blocks of FIG. 1.

In the preferred embodiment, the front wall 22A is 30 inches long, and the front wing walls 22B, 22C are 15 inches long. The included angle between the axes 26A, 26B and 26A, 26C are each 120 degrees. These angular relationships are indicated in FIG. 5 by the reference numerals 38A, 38B, respectively. It is expected that the front and back walls 22, 24 will be 7.75 inches high (the height of a conventional concrete block), and the upper and lower surfaces 18, 20 will be approximately three inches wide.

When the block 10 is made of concrete to the forgoing dimensions, it will weigh approximately 105 pounds, not including any internal reinforcement such as wire mesh. Although internal reinforcement has been found to be unnecessary for most applications, a suitable wire mesh is commercially available under the trademark DURA WALL or DURA BAR. DURA WALL and DURA BAR wire mesh is supplied in 10 foot lengths, five feet of which is needed for each block 10. Those skilled in the art will appreciate that the block 10 can be manufactured of other materials and/or other dimensions, if desired, but the preferred material and dimensions have been found to be effective and desirable because of ergonomic weight limitations. Other materials that can be used, depending on the user's needs, include various plastics such as polyethylene, concrete filled with plastic pellet aggregate, cinders, baked slate aggregate sold under the trademark SOLITE, vermiculite, or ore slag, or even plastic with embedded pressure-treated wood cores. Use of these alternate materials will produce somewhat lighter blocks; for example, when cinder-filled concrete is used, the block 10 will weigh under 90 pounds. The block 10 when made of concrete filled with SOLITE aggregate will weigh approximately 75–80 pounds.

Figure 6:
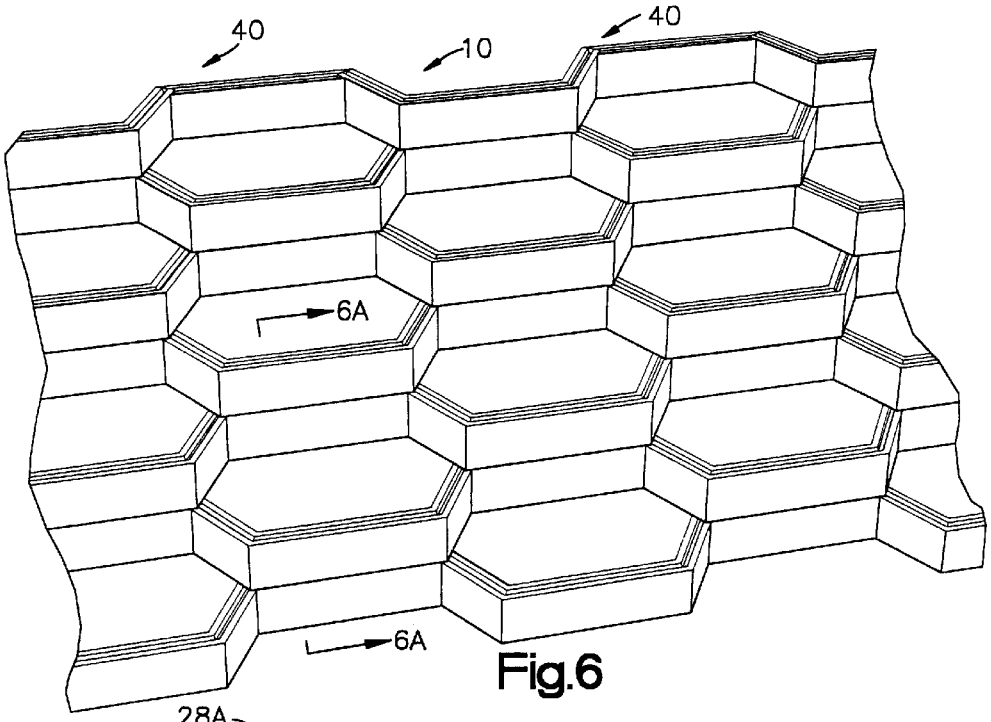
FIG. 6 is a view of the blocks of FIGS. 4 and 5 assembled to form a terraced retaining wall.
Figure 6A:
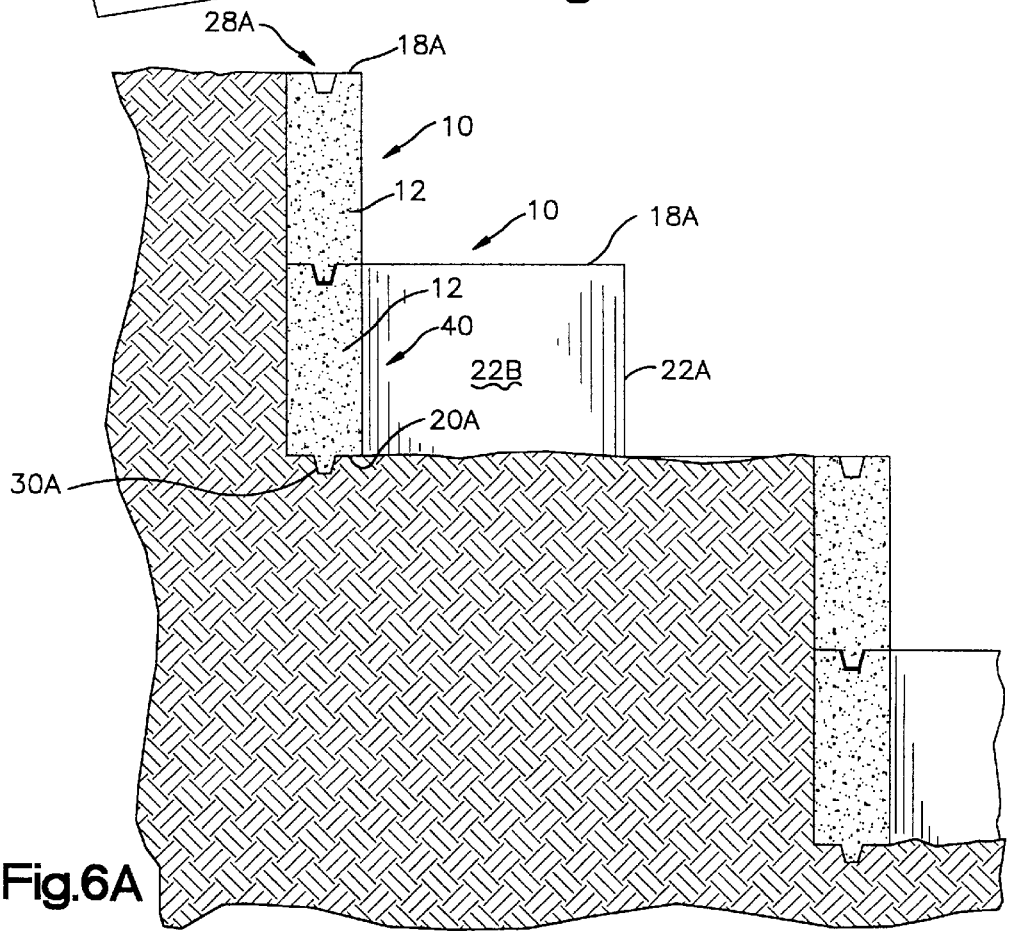
FIG. 6A is a view taken along a plane indicated by line 6A—6A in FIG. 6.

Referring now to FIGS. 4, 6, and 6A, a straight block 40 according to the invention is shown. Block 40 is similar to the center section 12 of the block 10 without the first and second wings 14, 16. Because the block 40 is similar in size and shape to the center section 12, like reference numerals will be used to describe the various components of the block 40. Accordingly, the block 40 has an upper surface 18A, a lower surface 20A, a front wall 22A, a back wall 24A, a longitudinal axis 26A, a groove 28A formed in the upper surface 18A, and a tongue 30A projecting from the lower surface 20A. Unlike the center section 12, however, the block 40 has notched end faces 42, 44, each of which has an angled surface 46 and an intersecting angled surface 48. The surfaces 46, 48 are disposed at right angles to each other. The angled surfaces 46 are disposed at an angle of 30 degrees relative to the longitudinal axis 26A, while the angled surfaces 48 are disposed at an angle of 60 degrees relative to the longitudinal axis 26A. The front face 22A of the block 40 is 26.5 inches long, while the back face 24A is 30 inches long.

Figure 8A:
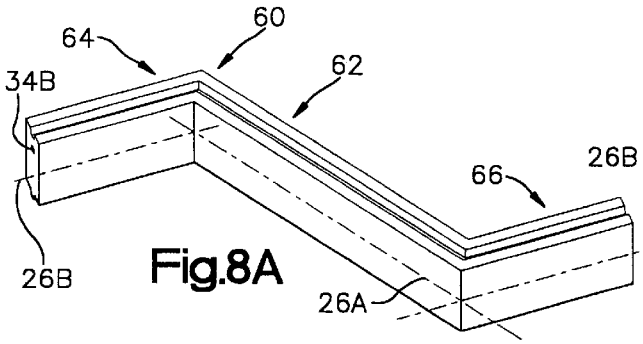
FIGS. 8A and 8B are perspective views of a generally Z-shaped block and a generally S-shaped block according to the invention.

Referring to FIG. 8A, another alternate block according to the invention is indicated by the reference numeral 60. The block 60 is generally Z-shaped. The block 60 includes a center section 62 and first and second wings 64, 66. Because the center section 62 and the first and second wings 64, 66 are substantially similar to the center section 12 and the first and second wings 14, 16, reference numerals from the section 12 and the first and second wings 14, 16 will be carried over to the section 62 and the first and second wings 64, 66, where appropriate.

The primary difference between the block 60 and the block 10 is that the first wing 64 is disposed on the opposite side of the longitudinal axis 26A from the first wing 14. The angle between the longitudinal axis 26A of the center section 62 and the longitudinal axis 26B of the first wing 64 is 240 degrees.

Figure 8B:
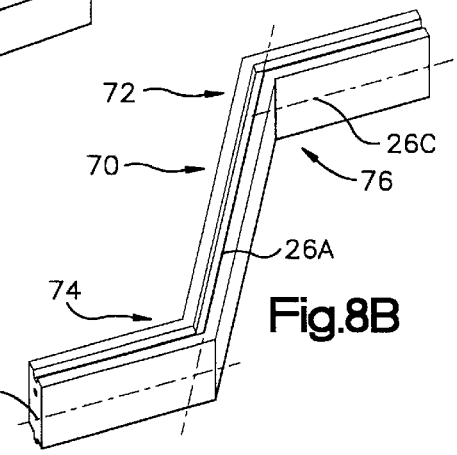

Referring now to FIG. 8B, yet another alternative embodiment of the block 10 is indicated by the reference numeral 70. The block 70 includes a center section 72, a first wing 74, and a second wing 76. The block 70 is generally S-shaped. As with the block 60, the block 70 is substantially similar to the block 10, except that the second wing 76 is disposed on the opposite side of the longitudinal axis 26A from the second wing 16. The angle between the longitudinal axis 26A and the longitudinal axis 26C for the center section 72 and the second wing 76 is 240 degrees.

Preferably the cross-section of each of the blocks 10, 40, 60, and 70 is constant throughout its length.

It is expected that various ones of the blocks 10, 40, 60, and 70 may be stacked atop each other to form structures in which all portions of the blocks are not superimposed, such as that indicated in FIG. 6. In order to prevent interference between the tongues 30 and the upper surfaces 18 at that location where the tongues 30 depart from the grooves 28, two possible modifications from that configuration shown in the Figures can be made. In one approach, as shown is FIG. 3A, the tongues 30A, 30B, and 30C can be terminated approximately three inches short of the intersection between the first and second wings as well as approximately three inches short of the ends of the wings. In the other approach, small channels 80 (FIG. 5) can be formed into the upper surfaces 18 at the intersection between the center section 12 and each of the wings 14, 16. The channels 80 should be slightly wider and deeper than the tongues 30. The channels 80 will accept the tongues 30A, 30B, 30C, thereby preventing any interference. The use of the channels 80 is preferred over shortening the tongues 30.

Examples Of Structures That Can Be Built With The Blocks 10, 40, 60, and 70.

1. Planter

Referring to FIG. 1, three of the blocks 10 can be assembled to form a hexagonal planter. The end faces 32B, 32C are connected by dowels 36, as indicated in FIG. 2, to provide a secure connection between adjacent blocks 10. The tongues 30A, 30B, 30C will be pressed into the ground providing further stability for the blocks 10.

2. Freestanding Wall

Figure 7:
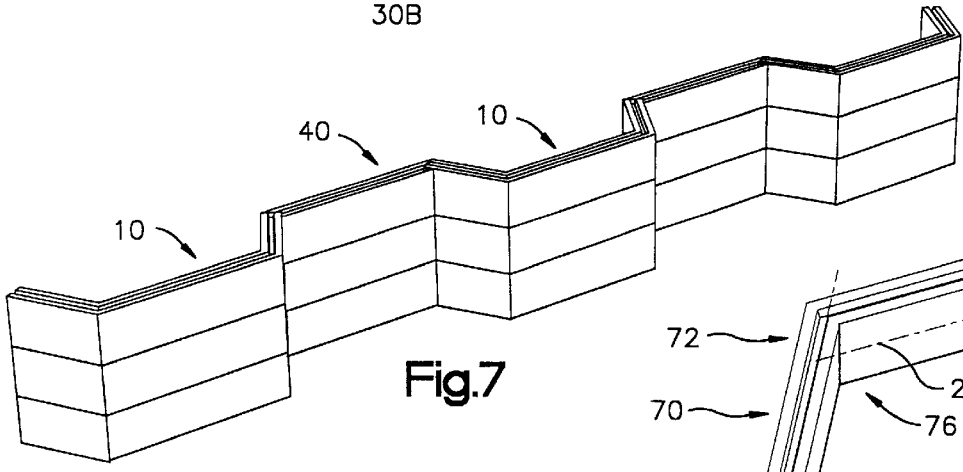
FIG. 7 is a perspective view of the blocks of FIGS. 4 and 5 assembled to form a serpentine wall.

Referring to FIG. 7, a freestanding wall employing the blocks 10 and 40 is shown. The wall has three courses of blocks, although additional courses of blocks could be added to increase the height of the wall, if desired.

Figure 9:
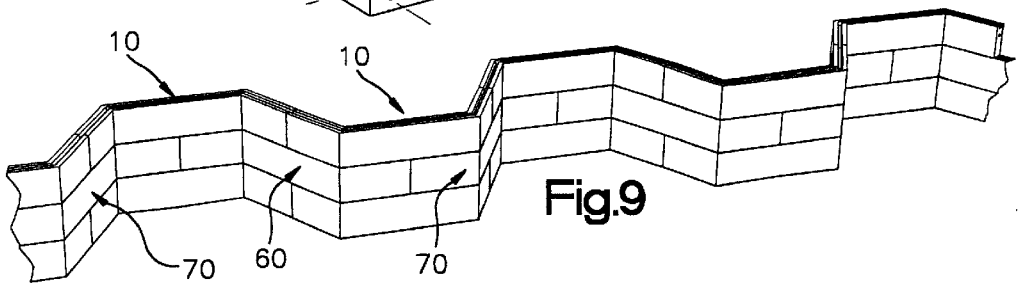
FIG. 9 is a view similar to FIG. 7 in which blocks shown in FIGS. 5, 8A, and 8B have been assembled to form a serpentine wall.

Another version of the freestanding wall is shown in FIG. 9. In FIG. 9, the wall is made by using combinations of blocks 10, 60, and 70. The wall as shown in FIG. 9 can be made higher than the wall shown in FIG. 7 because the interface between the end faces 32B, 32C of the blocks 10, 60, 70 of a given course are offset from the comparable interfaces of vertically adjacent courses so as to provide a sturdier structure than that shown in FIG. 7.

3. Terraced (Staircase) Retaining Wall

As shown in FIGS. 6 and 6A, blocks 10 and 40 can be assembled in a manner similar to that shown in FIG. 7 to produce a terraced, or staircase, retaining wall. This type of retaining wall is used for sloping hillsides. As can be seen in FIG. 6, each course is shifted laterally relative to the one below it so that the center sections 12 always are superimposed above a straight block 40. This construction is made possible either by providing channels 80 for the upper surfaces 18 or by limiting the length of the tongues 30A, 30B, 30C, as described previously. As shown in FIG. 6, this arrangement of blocks 10, 40 produces a retaining wall having a honeycomb appearance.

4. Pond for Aquatic Plants

Figure 10:
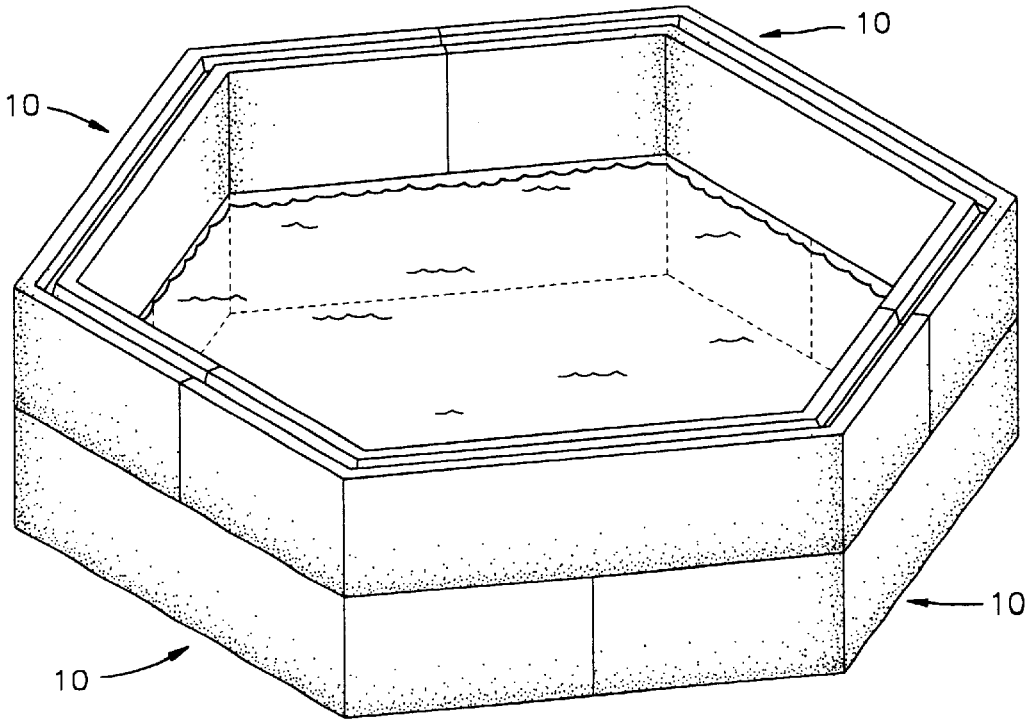
FIG. 10 is a view of a pond for aquatic plants formed by the assembly of the blocks illustrated in FIG. 5.

Referring to FIG. 10, a small pond can be formed by utilizing the planter of FIG. 1 and draping a water-impervious sheet liner over the open containment formed thereby. The sheet is pressed into place along the lower edges of the opening. Thereafter, a second course of blocks 10 is placed above the first course, trapping the sheet liner between the superimposed blocks 10. The sheet is trimmed along the outer edges in order to present a clean appearance. Thereafter, the enclosure can be filled with water up to the level defined by the upper surface of the first course of blocks 10. As with the wall shown in FIG. 9, the interface between the end faces 32B, 32C of the upper course of blocks 10 is offset from the comparable interface of the lower course of blocks 10.

5. Stair Steps On An Incline

Figure 11:
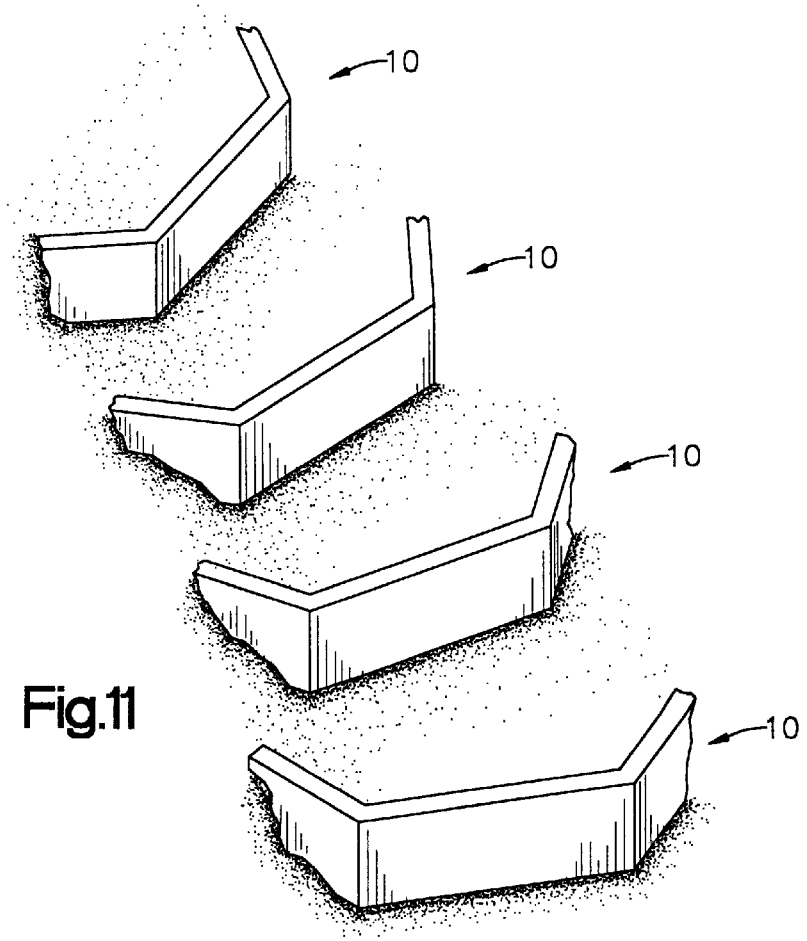
FIG. 11 is a view of the blocks of FIG. 5 spaced apart on a hillside to provide steps.

Referring to FIG. 11, a plurality of blocks 10 are spaced apart on an incline. The blocks 10 are set into the ground so that they will not move. The ground between the upper surface 18 of one block 10 and the lower surface of the adjacent block 10 is filled by dirt, gravel, small stones, pre-formed concrete panels, and the like. The blocks 10 thus form the riser portion of the stair steps for the incline. Preferably, the blocks 10 that are used in this manner will be manufactured without the groove 28 in the upper surface 28. Similarly, the blocks 10, 40, 60, 70 can be formed without the groove 28 when the blocks 10, 40, 60, 70 are used as the upper course of a structure.

6. Culvert Retention Wall

Figure 12:
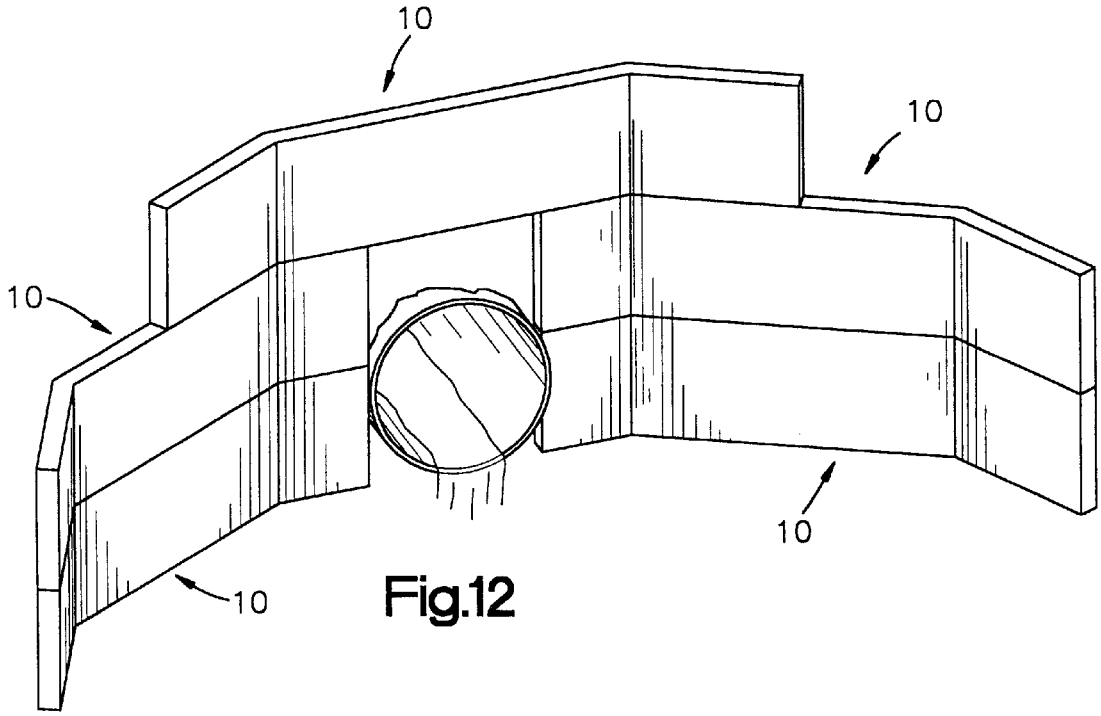
FIG. 12 is a view of a culvert retaining wall constructed of the blocks of FIG. 5.

Referring to FIG. 12, a culvert drain pipe is shown. The drain pipe is surrounded by a plurality of blocks 10 that are positioned atop each other so as to be disposed upon either side of the culvert pipe and on top the culvert pipe. In order to form the retention wall shown in FIG. 12, it is necessary to remove a portion or all of the first wings 14 and the second wings 16 on that side of the blocks 10 adjacent the pipe. By modifying the blocks 10 in this manner, the center sections 12 can be positioned close enough to receive a superimposed block 10.

7. Planter Retaining Wall

Figure 13:
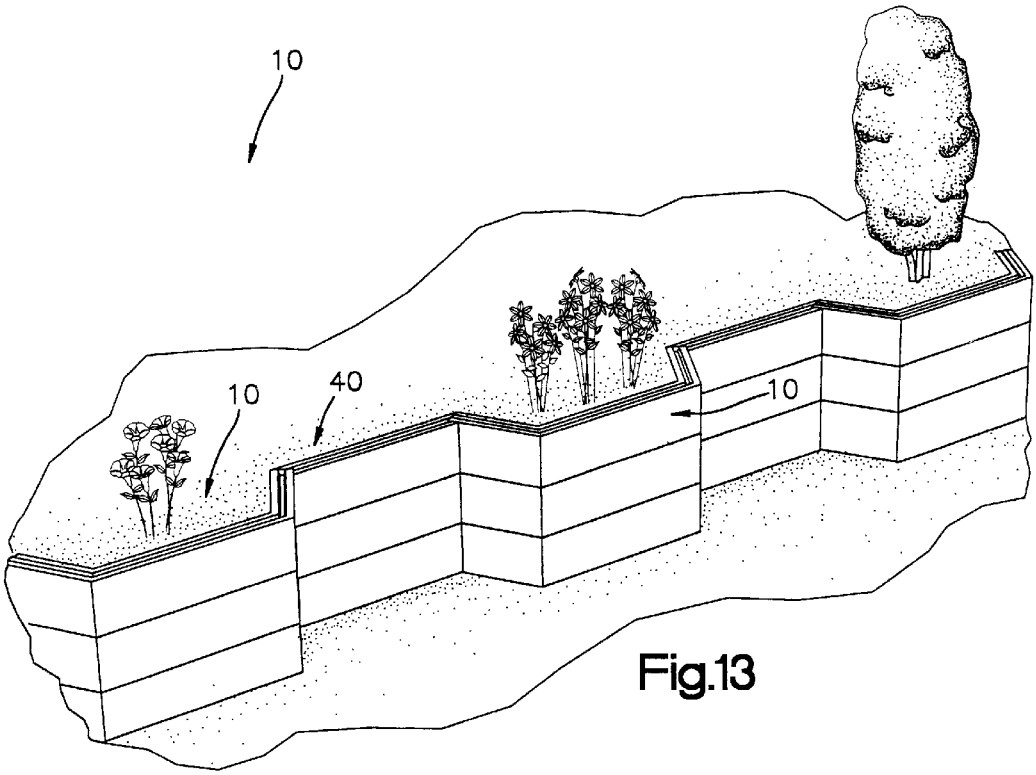
FIG. 13 is a view similar to FIG. 7 showing the wall used as a retaining wall.

Referring to FIG. 13, a planter retaining wall is shown. The wall is identical to the freestanding wall shown in FIG. 7 except that in this instance it retains dirt so that a planter can be formed.

8. Retention Wall For Ponds And Other Bodies Of Water

Figure 14:
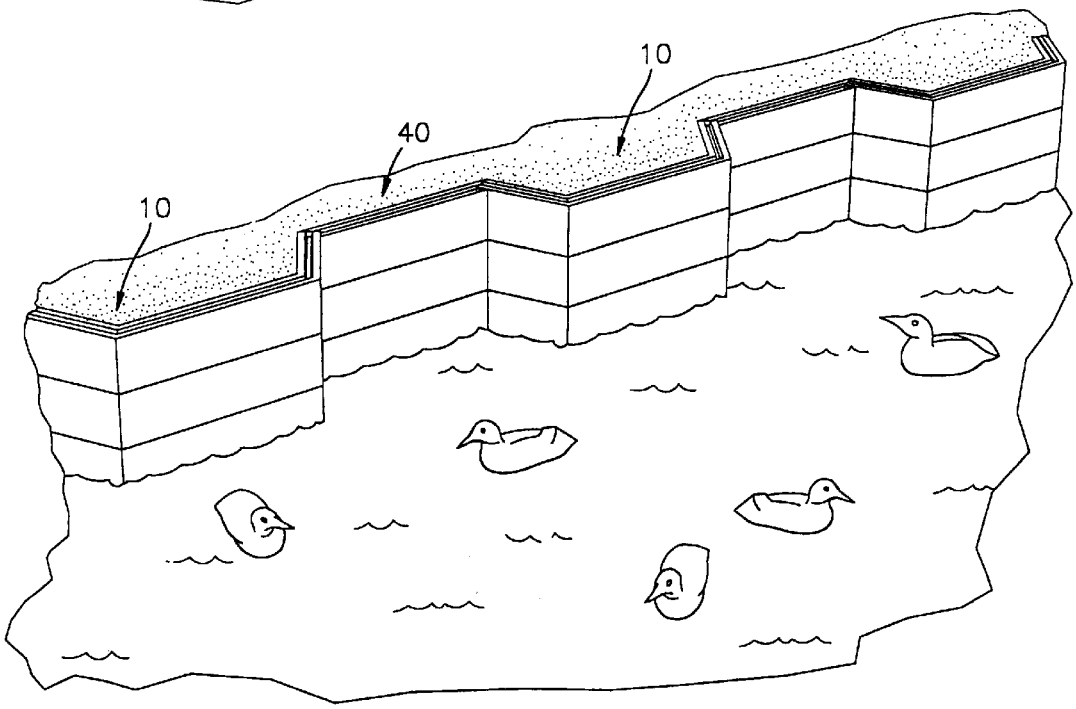
FIG. 14 is a view similar to FIG. 13 showing the wall of FIG. 7 used as a retaining wall for a body of water.

Referring to FIG. 14, the wall of FIG. 7 is used to define the interface between a bank and a body of water such as a pond, creek, and the like.

As will be apparent from the foregoing description, the construction blocks according the invention can be used to construct a wide variety of structures. Because the blocks are relatively small and simple in design, they can be manufactured inexpensively. They can be used for residential or commercial purposes and, when constructed into shapes such as those shown in the drawings, will produce attractive, sturdy structures. Because of their size and weight, these structures can be assembled without lifting equipment and can be quickly installed in remote locations with little surface or footing preparation.

Although the invention has been described in its preferred form with a certain degree of particularity, it will be understood that the present disclosure of the present embodiment has been made only by way of example, and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A construction block for use in constructing retaining walls, planters, ponds for aquatic plants, and similar structures, comprising:

an elongate center section having an upper surface, a lower surface, a front wall, a back wall, and a longitudinal axis, the center section having a length X measured along the longitudinal axis;

first and second wings connected to and extending outwardly from the center section, each wing having an upper surface, a lower surface, an end face, a front wall, a back wall, and a longitudinal axis, the first and second wings having a length ½X measured along the longitudinal axis;

the upper surfaces of the center section and the first and second wings having a groove formed therein of a pre-determined cross-section;

the upper surfaces of the center section and the first and second wings having channels formed therein, the channels opening into the groove and through the front walls, the channels being located at the intersection between the center section and the wings;

the lower surfaces of the center section and the first and second wings having a tongue projecting therefrom, the tongue being of a size and shape to fit within the groove of a similar block; and the longitudinal axis of the center section being disposed at an included angle of 120 degrees relative to the longitudinal axes of the first and second wings.

2. The construction block of claim 1, wherein the center section and the first and second wings are generally rectangular in cross-section.

3. The construction block of claim 2, wherein the cross-section of the block is constant throughout its length.

4. The construction block of claim 1, wherein the construction block is made of a material selected from the group consisting of concrete, polyethylene, plastic with embedded pressure-treated wood cores, concrete filled with plastic pellet aggregate, concrete filled with cinders, concrete filled with baked slate aggregate, concrete filled with vermiculite, and concrete filled with ore slag.

5. The construction block of claim 1, further comprising a first opening in the end face of the first wing, the first opening extending parallel to the longitudinal axis of the first wing; and a second opening in the end face of the second wing, the second opening extending parallel to the longitudinal axis of the second wing.

6. The construction block of claim 1, wherein the upper and lower faces of the center section and the first and second wings lie in common planes.

7. The construction block of claim 1, wherein the groove has a flat bottom and has sidewalls that taper from a larger dimension at the upper surface to a smaller dimension at the bottom.

8. The construction block of claim 1, wherein the tongue terminates a distance equal to or greater than three inches from (a) the intersection of the center section and the first and second wings, and (b) the end faces of the first and second wings.

9. The construction block of claim 1, wherein the upper surfaces of the center section and the first and second wings do not include a groove.

10. A construction block for use in constructing retaining walls, planters, ponds for aquatic plants, and similar structures, comprising:

an elongate center section having an upper surface, a lower surface, a front wall, a back wall, and a longitudinal axis, the center section having a length X measured along the longitudinal axis;

first and second wings connected to and extending outwardly from the center section, each wing having an upper surface, a lower surface, an end face, a front wall, a back wall, and a longitudinal axis, the first and second wings having a length ½X measured along the longitudinal axis;

the upper surfaces of the center section and the first and second wings having a groove formed therein of a pre-determined cross-section;

the upper surfaces of the center section and the first and second wings having channels formed therein, the channels opening into the groove and through the front walls, the channels being located at the intersection between the center section and the wings;

the lower surfaces of the center section and the first and second wings having a tongue projecting therefrom, the tongue being of a size and shape to fit within the groove of a similar block; and the longitudinal axis of the center section being disposed at an included angle of 120 degrees relative to the longitudinal axis of a selected one of the first wing or the second wing, and 240 degrees relative to the longitudinal axis of the other of the first wing or the second wing.

11. The construction block of claim 10, wherein the center section and the first and second wings are generally rectangular in cross-section.

12. The construction block of claim 11, wherein the cross-section of the block is constant throughout its length.

13. A The construction block of claim 10, wherein the longitudinal axis of the center section is disposed at an included angle of 120 degrees relative to the longitudinal axis of the first wing and 240 degrees relative to the longitudinal axis of the second wing.

14. The construction block of claim 10, wherein the longitudinal axis of the center section is disposed at an included angle of 240 degrees relative to the longitudinal axis of the first wing and 120 degrees relative to the longitudinal axis of the second wing.

15. The construction block of claim 10, wherein the construction block is made of a material selected from the group consisting of concrete, polyethylene, plastic with embedded pressure-treated wood cores, concrete filled with plastic pellet aggregate, concrete filled with cinders, concrete filled with baked slate aggregate, concrete filled with vermiculite, and concrete filled with ore slag.

16. The construction block of claim 10, further comprising a first opening in the end face of the first wing, the first opening extending parallel to the longitudinal axis of the first wing; and a second opening in the end face of the second wing, the second opening extending parallel to the longitudinal axis of the second wing.

17. The construction block of claim 10, wherein the upper and lower faces of the center section and the first and second wings lie in common planes.

18. The construction block of claim 10, wherein the groove has a flat bottom and has sidewalls that taper from a larger dimension at the upper surface to a smaller dimension at the bottom.

19. The construction block of claim 10, wherein the tongue terminates a distance equal to or greater than three inches from (a) the intersection of the center section and the first and second wings, and (b) the end faces of the first and second wings.

20. The construction of block of claim 10, wherein the upper surfaces of the center section and the first and second wings do not include a groove.

* * * * *